US010294711B2

(12) United States Patent
Ali et al.

(10) Patent No.: US 10,294,711 B2
(45) Date of Patent: May 21, 2019

(54) FIRE RESISTANT DOOR CORES, DOOR SKINS, AND DOORS INCLUDING THE SAME

(71) Applicant: Masonite Corporation, Tampa, FL (US)

(72) Inventors: Hussain Ali, Naperville, IL (US); Jamie Corcoran, Thorp, WI (US)

(73) Assignee: Masonite Corporation, Tampa, FL (US)

( * ) Notice: Subject to any disclaimer, the term of this patent is extended or adjusted under 35 U.S.C. 154(b) by 0 days.

(21) Appl. No.: 15/367,763

(22) Filed: Dec. 2, 2016

(65) Prior Publication Data

US 2017/0159350 A1 Jun. 8, 2017

Related U.S. Application Data

(60) Provisional application No. 62/262,092, filed on Dec. 2, 2015.

(51) Int. Cl.
*E06B 3/70* (2006.01)
*E06B 5/16* (2006.01)

(52) U.S. Cl.
CPC ..... *E06B 3/7015* (2013.01); *E06B 3/7001* (2013.01); *E06B 5/16* (2013.01); *E06B 2003/7042* (2013.01); *E06B 2003/7051* (2013.01)

(58) Field of Classification Search
CPC ..... E06B 3/70; E06B 3/7001; E06B 3/7015; E06B 2003/7023; E06B 2003/7051; E06B 2003/7042; E06B 5/16; E06B 5/162; E06B 5/161; E06B 5/167; E06B 5/20
See application file for complete search history.

(56) References Cited

U.S. PATENT DOCUMENTS 3,934,066 A 1/1976 Murch
4,265,067 A * 5/1981 Palmer ..... E06B 3/7001 52/309.9
4,801,496 A 1/1989 Buchacher
(Continued)

FOREIGN PATENT DOCUMENTS

AU 4176778 A 5/1979
EP 1584780 A2 10/2005
GB 2450728 A 1/2009

*Primary Examiner* — Jessica L Laux
(74) *Attorney, Agent, or Firm* — Berenato & White, LLC

(57) ABSTRACT

A door core includes a first major surface having one or more first recesses, a second major surface opposite to the first major surface, and fire retardant material such as intumescent material applied to the first recesses and no more than about 20 percent by surface area of a remainder of the first major surface excluding the first recesses. A door skin includes an interior surface, an exterior surface, at least one contoured panel portion establishing a protrusion extending on the interior surface and an opposite depression extending into the exterior surface, and fire retardant material such as intumescent material applied to at least one of the protrusion or the depression and no more than about 20 percent by surface area of the remainders of the interior surface excluding the protrusion and the exterior surface excluding the depression. Doors including the cores and/or door skins are also provided.

21 Claims, 8 Drawing Sheets

(56) References Cited

U.S. PATENT DOCUMENTS

| | | | | |
|---|---|---|---|---|
| 4,811,538 | A * | 3/1989 | Lehnert | E06B 5/16 428/70 |
| 4,930,276 | A * | 6/1990 | Bawa | E06B 5/162 52/208 |
| 5,887,402 | A | 3/1999 | Ruggie et al. | |
| 6,115,976 | A * | 9/2000 | Gomez | E06B 5/164 52/13 |
| 6,579,483 | B1 | 6/2003 | Vaders | |
| 6,643,991 | B1 | 11/2003 | Moyes | |
| 6,743,318 | B2 | 6/2004 | Vaders | |
| 6,745,526 | B1 | 6/2004 | Autovino | |
| 6,764,625 | B2 | 7/2004 | Walsh et al. | |
| 6,986,656 | B2 | 1/2006 | Moyes et al. | |
| 7,007,435 | B2 | 3/2006 | Ballantyne | |
| 7,096,916 | B2 | 8/2006 | Vaders | |
| 7,695,658 | B2 | 4/2010 | Hardwick et al. | |
| 7,832,166 | B2 | 11/2010 | Daniels | |
| 7,897,235 | B1 | 3/2011 | Locher et al. | |
| 7,998,382 | B2 | 8/2011 | Hardwick et al. | |
| 8,209,866 | B2 | 7/2012 | Daniels | |
| 8,341,919 | B2 | 1/2013 | Hardwick et al. | |
| 8,381,381 | B2 | 2/2013 | Daniels | |
| 8,397,864 | B2 | 3/2013 | Tinianov et al. | |
| 8,881,494 | B2 | 11/2014 | Daniels et al. | |
| 8,915,033 | B2 | 12/2014 | Daniels et al. | |
| 9,027,296 | B2 | 5/2015 | Daniels et al. | |
| 2006/0248833 | A1* | 11/2006 | Autovino | E06B 3/72 52/455 |
| 2007/0110979 | A1 | 5/2007 | Clark et al. | |
| 2012/0159855 | A1* | 6/2012 | Pfau | B29C 7/102 49/381 |
| 2014/0260080 | A1* | 9/2014 | Swartzmiller | E06B 3/72 52/784.1 |
| 2015/0183197 | A1 | 7/2015 | Riebel et al. | |

* cited by examiner

FIRE RESISTANT DOOR CORES, DOOR SKINS, AND DOORS INCLUDING THE SAME

CROSS-REFERENCE TO RELATED APPLICATION AND CLAIM TO PRIORITY

This application claims the benefit of priority of U.S. Provisional Application No. 62/262,092 filed Dec. 2, 2015, the complete disclosure of which is incorporated herein by reference.

FIELD OF THE INVENTION

The present invention relates to fire resistant doors and door components, especially door cores and door skins, and to doors including one or more fire resistant door cores and/or fire resistant door skins, and to methods of making and using the same.

BACKGROUND OF THE INVENTION

Hollow core doors and solid core doors having compression molded door facings are well known in the art. Typically, the door includes a perimeter frame, which includes right and left stiles and top and bottom rails attached together end-to-end to form a rectangular frame. Interior major surfaces of door skins (also referred to in the art and herein as door facings) are secured to opposite sides of the frame, typically using adhesive and/or fasteners.

There are several known techniques for making door skins. For example, the door skins may be formed by pressing a planar cellulosic mat or a fiberglass composite material, such as sheet molding compounds, in a compression mold press. Alternatively, pre-consolidated blanks may be pressed in the mold press to form the door skins. Other molding techniques may also be practiced.

A pressed door skin may be a "flush" door skin with planar interior and exterior surfaces. Alternatively, a pressed door skin may be shaped to include one or more molded contoured portions, also known as ovalos. Typically, the contours are continuous structures that define a square, rectangle, circle, or oval when viewed from an elevational viewpoint, although the contours may define other shapes. The area within the continuous contours is typically planar and gives the appearance of an interior panel that has been formed by machine routing. The contours appear from the exterior side of the door skin as depressions extending inwardly into the exterior surface of the door skin, and appear from the interior side view point as protrusions extending from the interior surface away from the exterior side.

A cavity is defined by the frame and the interior surfaces of the opposing door skins. If left empty, the hollow cavity typically causes the door to be lighter than a comparably sized solid, natural wood door. Such an artificially light weight hollow core door is not desirable for many consumers who expect the feel and weight of the door to replicate solid natural wood. In addition, the sound and/or heat insulation provided by hollow core doors are typically less than may be desired or specified. Therefore, it is often desirable to use a core structure (e.g., one or more core pieces or core components) to fill the cavity. Such core-containing doors are generally known as solid core doors. The core structure is flanked on its opposite major surfaces by door skins, and is surrounded at its periphery by the door frame. To enhance the heat and fire preventive properties of the solid core door, a fire retardant may be incorporated into the core structure composition as an additive. Alternatively, the core itself may be a fire resistant material, such as made from pearlite, vermiculite or the like.

As described above, in the case of a solid core door having molded door skins with contours, the protrusions extending inwardly from the interior sides of the door skins into the cavity impinge upon the space available for the core structure. Consequently, the core structure is provided with a lesser thickness, at least in the regions of the cavity corresponding to the molded door skin contours, to accommodate the inwardly extending contour protrusions. U.S. Pat. No. 5,887,402 to Ruggie et al. describes a solid core door including a core component having its major surfaces machine routed to include recesses at regions of the core component corresponding to the location of the contours of the door skin. The contour protrusions on the interior sides of the door skins are at least partially accommodated or received in the recesses. The areas of the core component surrounding the recessed regions have a greater thickness than the recessed regions to fill the cavity regions between the planar portions of the door skins. U.S. Pat. No. 6,764,625 discloses molding a fiber/resin mat in a conventional press to include recesses corresponding to the configuration of the depressions of the door skins. U.S. Pat. Nos. 7,695,658, 7,998,382, and 8,341,919 disclose pressing a pre-consolidated mat in a mold cavity to form at least one recess that corresponds to the configuration of a depression of a door skin.

The present inventors have observed that the core recesses machined, molded, or otherwise formed in the door core structure to accommodate the door skin contours may adversely affect the heat and fire resistant properties of the resulting door. When a side of a door having the recessed core structure is exposed to fire, the flow of heat to the non-exposed side of the door is greater at the core recessed areas, where core insulation material has been removed to accommodate the molded contours of the door skin, than at the thicker surrounding areas of the core structure that have a greater thickness. Many localities and/or building owners may specify requirements of a "fire rated" door. As identified by the inventors, an increase in the heat resistance in the recessed areas of the door core may be desirable in order to allow paneled doors to be utilized in such applications. American National Standards Institute ANSI/UL-10C is one standard used for evaluating the fire resistance of doors.

SUMMARY OF THE INVENTION

A first aspect of the invention provides a door core including a first major surface having one or more first recesses defining one or more first recessed portions of the first major surface, a second major surface opposite to the first major surface, and fire retardant material coating the first recessed portions and no more than 20 percent by surface area of a remainder of the first major surface excluding the first recessed portions.

A second aspect of the invention provides a solid core door including a frame having opposite first and second sides, a core having a perimeter surrounded by the frame, a first door skin secured to the first side of the frame, and a second door skin secured to the second side of the frame. The core includes a first major surface having one or more first recesses defining one or more first recessed portions of the first major surface, a second major surface opposite to the first major surface, and fire retardant material coating the first recessed portions and no more than 20 percent by surface area of a remainder of the first major surface excluding the first recessed portions.

According to a third aspect of the invention, a door skin is provided that includes an interior side associated with an interior surface, an exterior side associated with an exterior surface, at least one contoured panel portion establishing a protrusion extending on the interior surface toward the interior side and an opposite depression extending into the exterior surface away from the exterior side, and fire retardant material coating at least one of the protrusion or the depression, no more than 20 percent by surface area of a remainder of the interior surface excluding the protrusion, and no more than 20 percent by surface area of a reminder of the exterior surface excluding the depression.

A fourth aspect of the invention provides a solid core door including a frame having opposite first and second sides, a door core including a first major surface having one or more first recesses and a second major surface opposite to the first major surface, a first door skin secured to the first side of the frame, and a second door skin secured to the second side of the frame. The first door skin includes an interior side associated with an interior surface, an exterior side associated with an exterior surface, at least one contoured panel portion establishing a protrusion on the interior surface extending to the interior side and an opposite depression extending into the exterior surface extending away from the exterior side, and fire retardant material coating at least one of the protrusion or the depression, no more than 20 percent by surface area of a remainder of the interior surface excluding the protrusion, and no more than 20 percent by surface area of a reminder of the exterior surface excluding the depression. At least a portion of the protrusion is received in the one or more first recesses of the door core.

According to an embodiment of the above aspects, the fire retardant material coats no more than 5 percent by surface area, preferably no more than 2 percent by surface area, or preferably none of the remainder of the first major surface excluding the first recessed portions. Optionally, any and all of the fire retardant material coated on the remainder of the first major surface is contiguous with the fire retardant material coating the first recessed portions.

According to another embodiment of the above aspects, the second major surface of the door core includes one or more second recesses defining one or more second recessed portions of the second major surface. Optionally, the second recessed portions mirror the location and shapes of the first recessed portions. The fire retardant material coats no more than 5 percent by surface area, preferably no more than 2 percent by surface area, or preferably none of the remainder of the first and second major surfaces excluding the first and second recessed portions. Optionally, any and all of the fire retardant material coated on the remainder of the first and second major surfaces is contiguous with the fire retardant material coating the first and second recessed portions.

According to a further embodiment of the above aspects, the fire retardant material is coated on no more than 5 percent by surface area, preferably no more than 2 percent by surface area, or preferably none of the remainder of the interior surface of the door skin(s) excluding the protrusion and/or no more than 5 percent by surface area, preferably no more than 2 percent by surface area, or preferably none of the remainder of the exterior surface of the door skin(s) excluding the depression.

According to still a further embodiment, the fire retardant material comprises or consists essentially of an intumescent material. According to yet a further embodiment, the fire retardant material comprises or consists essentially of a non-intumescent material.

The above aspects and embodiments may be combined and practiced with one another in any combination, including in combination with further exemplary embodiments described below and illustrated in the drawings.

Other aspects and embodiments of the invention, including articles, door skins, doors, structures, components, assemblies, apparatus, kits, methods and processes of making and using, and the like which constitute part of the invention, will become more apparent upon reading the following detailed description of the exemplary embodiments.

BRIEF DESCRIPTION OF THE DRAWINGS

The accompanying drawings are incorporated in and constitute a part of the specification. The drawings, together with the general description given above and the detailed description of the exemplary embodiments and methods given below, serve to explain principles of the invention. In such drawings.

Figure 1:
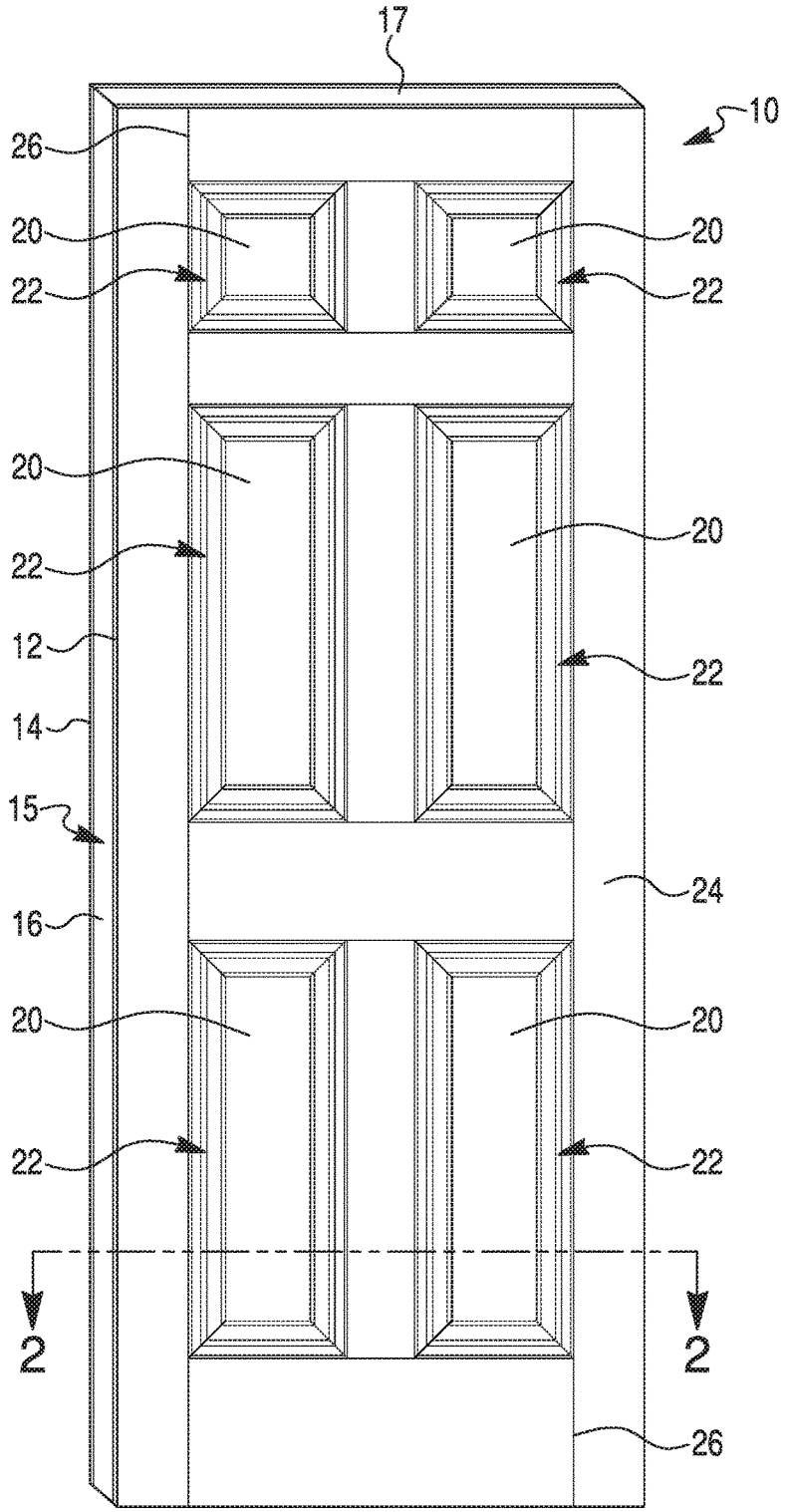
FIG. 1 is a perspective view of a six-panel solid core door according to an exemplary embodiment of the invention.

DETAILED DESCRIPTION OF EXEMPLARY EMBODIMENTS AND EXEMPLARY METHODS OF THE INVENTION

Reference will now be made in detail to the exemplary embodiments and methods as illustrated in the accompanying drawings, in which like reference characters designate like or corresponding parts throughout the drawings. It should be noted, however, that the invention in its broader aspects is not necessarily limited to the specific details, representative materials and methods, and illustrative examples shown and described in connection with the exemplary embodiments and methods.

Referring to FIGS. 1-4, there is illustrated an embodiment of a multi-panel door, generally designated by reference numeral 10, including a first door skin 12 and a second door skin 14. The door skins 12 and 14 may be identical, as shown, by molding the skins 12, 14 in the same molding apparatus and from the same materials. The first door skin 12 has a first exterior surface 12*a* and an opposite first interior surface 12*b*. Likewise, the second door skin 14 has a second exterior surface 14*a* and an opposite second interior surface 14*b*. The first and second exterior surfaces 12*a* and 14*a* are opposite or face away from one another. The first and second interior surfaces 12*b* and 14*b* face towards one another. The door skins 12 and 14 preferably are made from wood composite materials, although it is contemplated that the door skins 12 and 14 may be made from fiberglass reinforced polymer materials or other materials.

Although not shown, the exterior surfaces 12*a* and 14*a* may be molded, embossed, or otherwise provided with a surface pattern or texture, such as a wood grain pattern and/or wood tonal areas that replicate the natural background tones of natural wood. The exterior surfaces 12*a* and 14*a* may have one or more coatings, which may include, for example, paint, stain, lacquer, and/or a protective finish.

Figure 2:
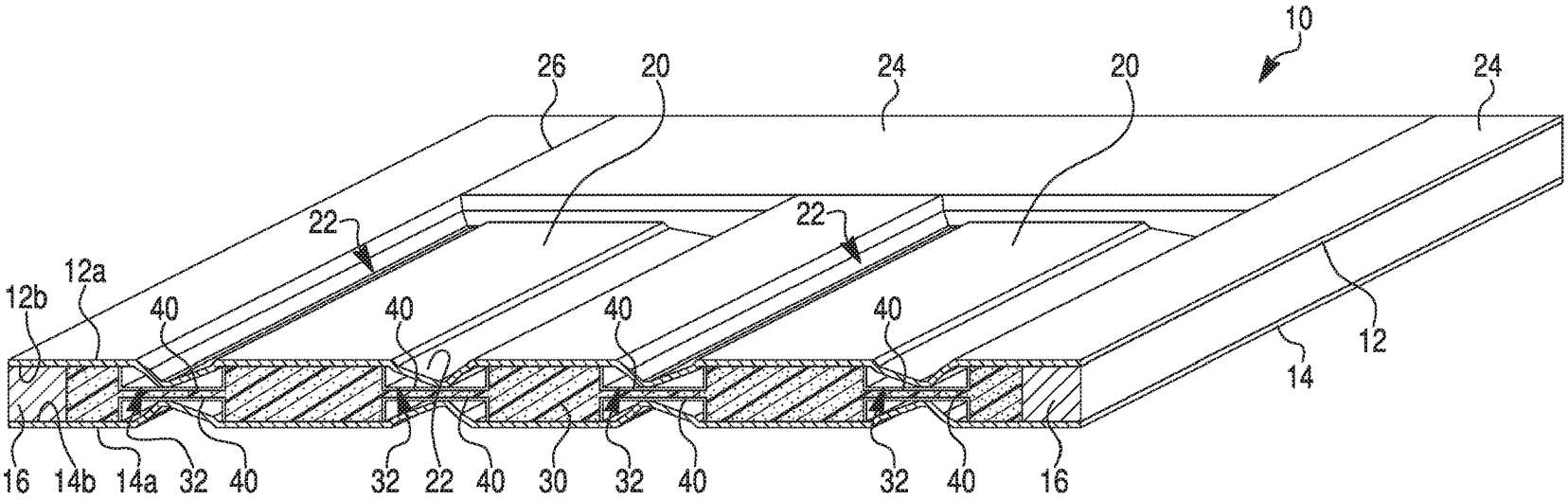
FIG. 2 is a cross-sectional view of the solid core door taken along section line 2-2 of FIG. 1 viewed in the direction of the arrows.

The door skins 12 and 14 are secured, such as adhesively and/or with fasteners, to opposite surfaces of a support structure 15, such as a door frame including left and right stiles 16 and top and bottom rails (with only top rail 17 being shown in FIG. 1). The stiles 16 are best shown in FIG. 2, and extend the height (length) of the door skins 12 and 14. The rails 17 have cross sections like those of the stiles 16 shown in FIG. 2, and may extend along the top and bottom edges of the multi-panel door 10. Intermediate rails and/or stiles may also be included as part of the support structure 15. The stiles 16 of the support structure 15 may establish left and right edges of the multi-panel door 10, and the rails 17 of the support structure 15 may establish the top and bottom edges of the multi-panel door 10. The stiles 16 and the rails 17 may be made of any suitable material, such as wood, composite, or metal. The thicknesses of the door skins 12, 14 have been exaggerated in the perspective view of FIG. 1 for illustrative purposes.

The door skins 12 and 14 of the first illustrated embodiment of FIGS. 1-4 are embodied as six-panel skins. The exterior surface 12*a* and the interior surface 12*b* of the first door skin 12 form six planar inner panels 20 lying in a common plane with one another. In the illustrated embodiment, each of the inner panels 20 possesses a rectangular or square perimeter. Variations and modifications to the design of the door skins 12 and 14 may be implemented. For example, the door skins 12 and 14 may have one, two, three, four, or more inner panels. The perimeters of the inner panels 20 may establish other shapes, such as other polygons, circles, ovals, etc. The inner panels 20 may have the same or different shapes and/or dimensions from one another. Similarly, the door skins 12 and 14 may have an identical or different arrangement of inner panels 20 and other surface features (e.g., embossed wood grain) on their respective exterior surfaces 12*a* and 14*a*.

Figure 7:
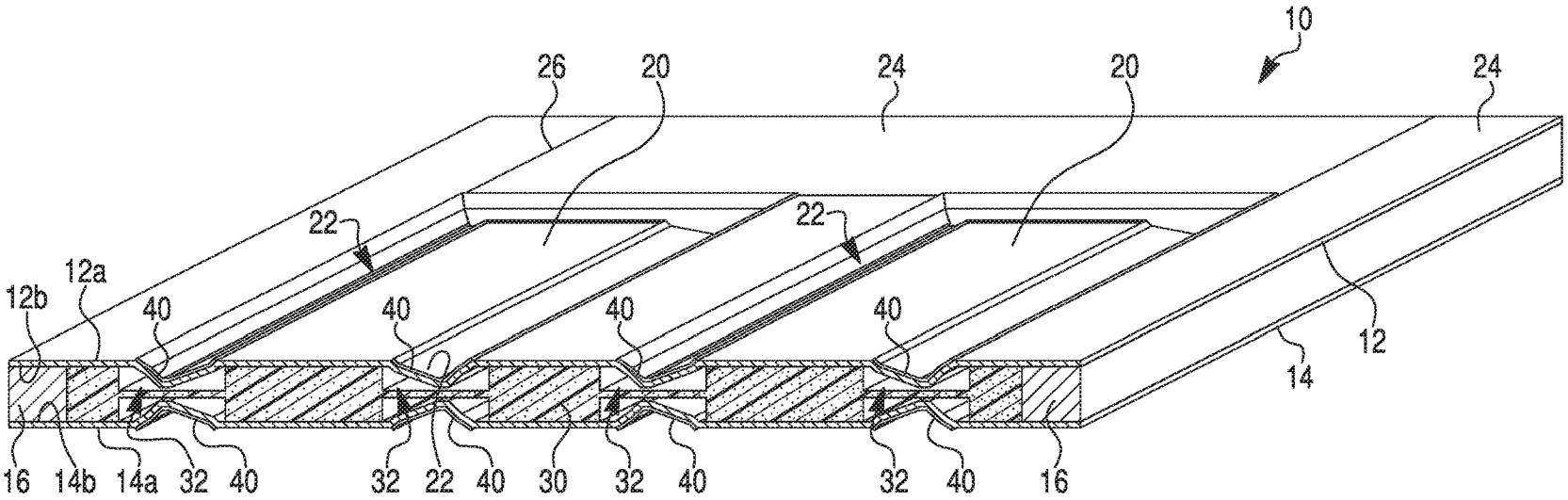
FIG. 7 is a cross-sectional view taken along sectional line 7-7 of FIG. 6.

A main body portion 24 surrounds the inner panels 20. The main body portion 24 is planar and extends continuously to the perimeter edges of the door skin 12, where the main body portion 24 is secured to the support structure 15 using adhesive and/or fasteners. In the illustrated embodiment, the main body portion 24 extends in a plane that is coplanar with a plane in which the inner panels 20 extend. Alternatively, the inner panels 20 may extend in a plane to either side of the plane of the main body portion 24 to create the appearance of recessed panels or protruding panels. The main body portion 24 is shown with vertical strike lines 26 embossed in the exterior surface 12*a*, as best viewed in FIGS. 1 and 2. As shown in FIG. 7, these embossed strike line features do not appear on the interior surface 12*b*.

Surrounding each inner panel 20 is a respective contoured portion 22 or ovalo, which continuously and integrally connects the inner panels 20 to the main body portions 24. As best shown in FIG. 1, each of the contoured portions 22 has a continuous square or rectangular appearance from a front elevational viewpoint. The contoured portions 22 may replicate fine millwork. For example, the contoured portions 22 may include a bead-and-cove design. When viewed from the interior side of the door skin 12, the contoured portions 22 define continuous protrusions extending on the planar portions of the interior surface 12*b* toward a door core 30 on the interior side of the door skin 12. When viewed from the exterior side of the door skin 12, the contoured portions 22 define continuous depressions extending into the planar portions of the exterior surface 12*a* toward the door core 30 and away from the exterior side of the door skin 12.

Figure 3:
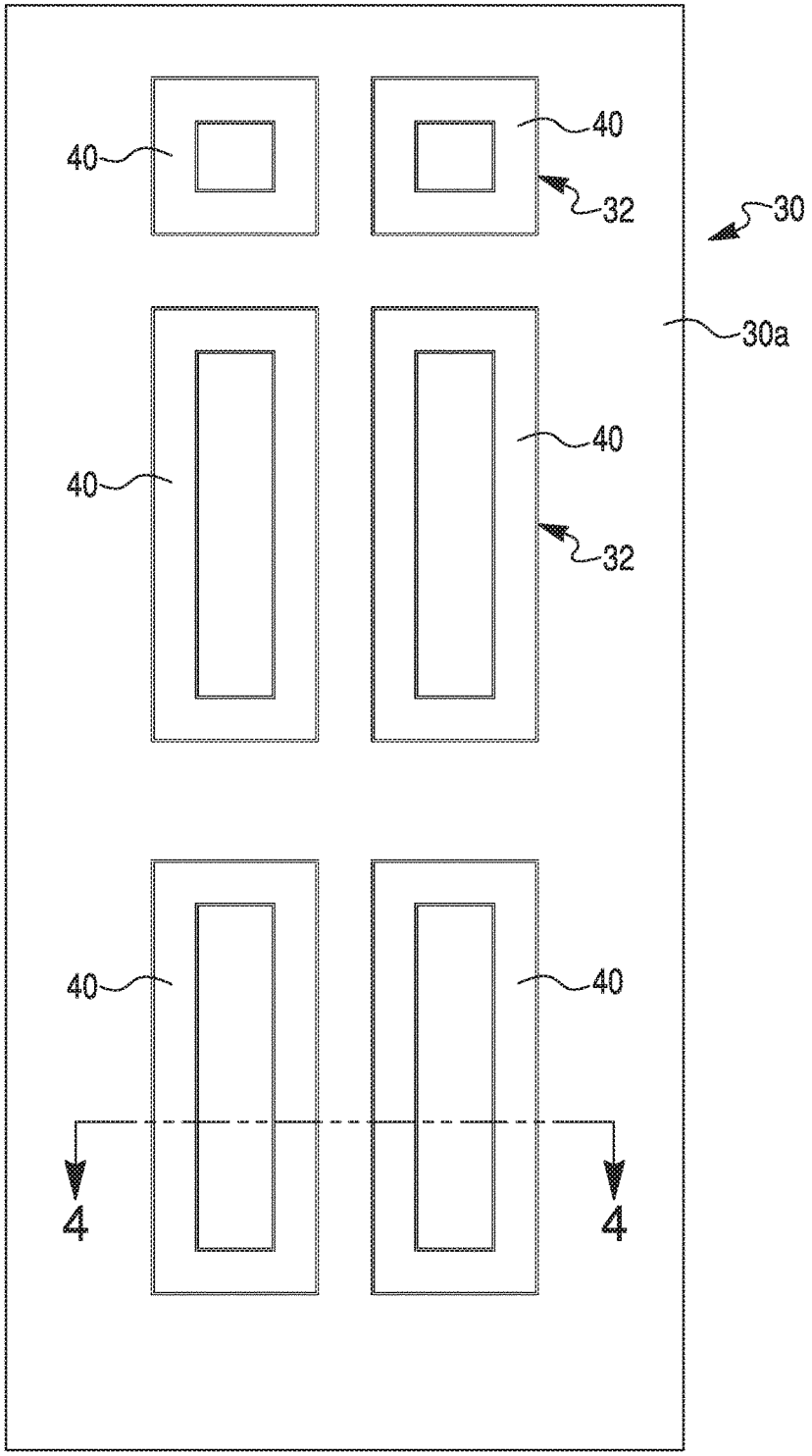
FIG. 3 is an elevational view of a door core of the six-panel solid core door of FIGS. 1 and 2, with the door core selectively coated with fire retardant material in recessed areas of the door core.
Figure 4:
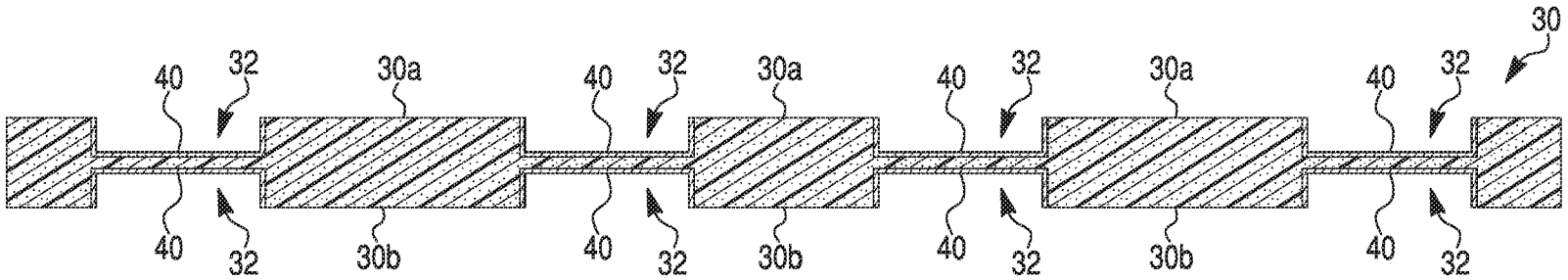
FIG. 4 is an enlarged cross-sectional view of the door core taken along section line 4-4 of FIG. 3 viewed in the direction of the arrows.

The door core 30 shown in FIGS. 2-4 is configured for use with the six-panel door skins 12 and 14 of the exemplary embodiment. The door core 30 has opposite first and second major surfaces 30*a* and 30*b* (FIGS. 3 and 4) facing and typically abutting the first interior surface 12*b* of the first door skin 12 and the second interior surface 14*b* of the second door skin 14, respectively. Adhesive may be applied to the first and second major surfaces 30*a* and 30*b* and/or the interior surfaces 12*b* and 14*b* for securing the door skins 12 and 14 to the door core 30. As noted above, adhesive also may be applied to the opposite sides of the support structure 15.

The first and second major surfaces 30*a* and 30*b* have a plurality of recesses 32 configured to receive the contoured portions 22 of the first and second door skins 12 and 14, respectively. The recesses 32 are shown as continuous square or rectangular areas, as best shown in FIGS. 2 and 4, corresponding in shape and location to the contoured portions 22 of the door skins 12 and 14. Because the first and second door skins 12 and 14 are identical to one another in the illustrated embodiment, the recesses 32 of the first and second major surfaces 30*a* and 30*b* are mirror images of one another. The recesses 32 may be formed, for example, by routing or molding operations, such as by compression molding a mat to form the core structure 30, as described for example in U.S. Pat. Nos. 5,887,402, 6,764,625, 7,695,658, 7,998,382, and 8,341,919.

Figure 5:
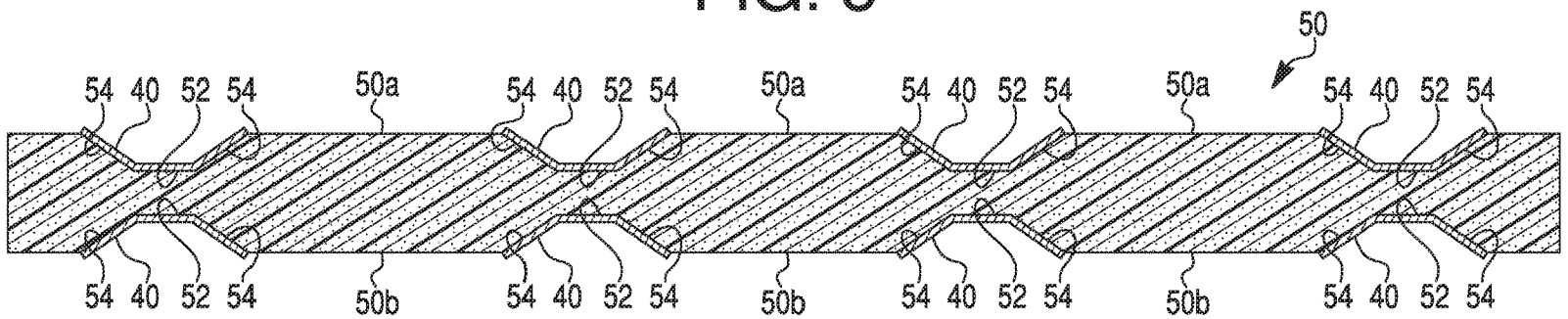
FIG. 5 is an enlarged cross-section view similar to that of FIG. 4 of a door core of a solid core door according to a modified exemplary embodiment of the invention.

The recessed portions (defined by the recesses 32 and therefore also designated by reference numeral 32) of the door core 30 are best shown in FIGS. 2 and 4 with opposite sidewalls parallel to one another, and a bottom surface extending between the sidewalls, wherein the sidewalls are perpendicular to the bottom surface. The recessed portions 32 may have other shapes, including those more closely matching the shapes of the contoured portions 22 of the door skins 12 and 14. For example, FIG. 5 illustrates a modification of the first embodiment of a door core 50 that may be substituted for core 30 into the door 10 of FIGS. 1 and 2. The door core 50 has opposite surfaces 50*a* and 50*b*. Recessed portions of the surfaces 50*a* and 50*b* include a bottom surface 52, and sidewalls 54 obliquely angled relative to the bottom surface 52. The specific number and configuration of the recessed portions 32 may vary depending upon the number and configurations of the contoured portions 22 of the door skins 12 and 14. At least a portion of the contoured portions 22 extends into and is thereby accommodated in the recesses 32.

The thickness of the recessed portions 32 is less than the thickness of the surrounding areas of the core structure 30, i.e., those areas corresponding to where the major surfaces 30*a*, 30*b* interface the inner panels 20 or the main body portion 24. Although not shown, an adhesive may be applied to the opposite major surfaces 30*a* and 30*b* of the door core 30, the support structure 15, and/or the interior surfaces 12*b* and 14*b* of the door skins 12 and 14 to secure the door skins 12 and 14 to the support structure 15 and the door core 30. Additionally or alternatively, mechanical fasteners (e.g., screws, nails, etc.) may be used to secure the door skins 12 and 14 to the support structure 15 and the door core 30.

Various known and useful materials may be used as the door core 30. For example, the door core 30 may be made of, for example, cellulosic material and a binder resin such as a urea-formaldehyde, phenol-formaldehyde, and/or melamine-formaldehyde thermosetting resin. Methylene di-p-phenylene isocyanate (MDI) resin may also or alternatively be used. The cellulosic material may be, for example, cellulosic fibers, cellulosic particles, wood flakes, wood flour, and straw fibers. The door core 30 may further include fillers and other additives, including fire retardants. The door core 30 may be made of a single or unitary piece, or may comprise a plurality of pieces.

To reduce heat flow through the reduced-thickness recessed portions 32 of the door core 30, in the first exemplary embodiment the recessed portions 32 are coated with fire retardant material 40, as best shown in FIGS. 3 and 4. The fire retardant material 40 preferably covers all of the bottom wall and optionally the side walls of the recessed portions 32. FIG. 5 shows the modified embodiment with the fire retardant material 40 coated on the bottom surface 52 and the sidewalls 54 of the recessed portions of the opposite surfaces 50*a* and 50*b* of the door core 50. Preferably, the fire retardant material 40 provides the recessed portions 32 with the same or better heat and fire resistant properties than surrounding thicker portions of the door core 30 that are not coated with fire retardant material.

The fire retardant material 40 may be an intumescent material or non-intumescent material. Without wishing to be bound by any theory, it is believed that intumescent material in the recessed portions 32 acts as a heat sink to provide added thermal insulation against heat flow and limit conditions that would encourage flaming. The intumescent material may act as a thermal barrier which expands upon exposure to heat, such as caused by fire, to cause local delamination of the door core structure 30 or 50 from the non-exposed side of the door 10. The delamination creates an air gap, which acts as further insulation between the heated door core 30 or 50 and the non-exposed door skin 12 and 14. Typically, fire is exposed to only one of the door skins 12 or 14, with the result that the heat generated by the fire causes heat to flow from the exposed door skin 12 or 14 through the door core 30 to the non-exposed door skin 12 or 14. The generation of the air gap by the intumescent material thus increases the thermal resistance of the door 10 and/or the door core 30 in the area of the recessed portions 32 in order to increase the thermal resistance to approximately that of the adjacent full thickness areas of the door core 30.

The inventors have found that the fire retardant material 40 is not needed at the thicker areas of the door core 30 surrounding the recessed portions 32 because of their greater thickness and, consequently, the greater amount of fire retardant incorporated into the door core 30 at those thicker areas. The fire retardant material 40 is selectively applied to the recessed portions 32, and not necessarily to the remainder of the door core major surfaces 30*a* and 30*b* outside of the recessed portions 32, that is, the portions of the major surfaces 30*a* and 30*b* corresponding to the main body portion 24 and the inner panels 20. Preferably, the fire retardant material 40 coats no more than about 20 percent, more preferably no more than about 5 percent, still more preferably no more than about 2 percent by surface area of a remainder of the major surfaces 30*a*, 30*b* outside of, excluding, the recesses 32. The non-recessed areas typically are flat so that calculation of their surface areas is relatively easy to accomplish. As shown, the fire retardant material 40 is isolated inside the recesses 32 and coats none of the surrounding planar areas of the major surfaces 30*a* and 30*b* outside of the recesses 32 that face the main body portion 24 and the inner panels 20 of the door skins 12 and 14. This selective and judicious use of the fire retardant material 40 reduces costs while not sacrificing thermal and fire resistant properties of the resulting door core 30.

In applying the fire retardant material 40, a relatively small amount (e.g., 20 percent or less by surface area, preferably about 5 percent or less by surface area, preferably about 2 percent or less by surface area) of the fire retardant material 40 may spread or overlap onto the areas of the major surfaces 30*a*, 30*b* outside of, i.e., excluding, the recesses 32. The remainder of the surfaces 30*a*, 30*b*(i.e., 80 percent or more by surface area, 95 percent or more by surface area, or 98 percent or more by surface area) is not coated with (that is, is free of) any fire retardant material 40.

Without necessarily being limited by any theory, intumescent materials typically swell as a result of exposure to heat, increasing in volume and decreasing in density. Typically, intumescent materials produce char, which is a poor heat conductor, when exposed to heat. The poor heat conductivity of char reduces heat transfer through the door 10 from the fire-exposed side to the non-exposed side. Exemplary intumescent materials are commercially available and include Tecnofire® LE commercially available from Technical Fiber Products Ltd through Lorient North America; Pyrosal® and Palusol® commercially available from BASF; Pyrocol by Odice; Interdens by Mann McGowan; and RUFR-1000 commercially available from Tembec Inc. Alternatively, the fire retardant material 40 may be a non-intumescent material, such as MIL-PRF-24596A flame retardant latex enamel from Sherwin Williams®.

The fire retardant material 40 may be applied, for example, as one, two, three, or more solid layers, films, strips (optionally applied with adhesive), or as a liquid applied in one, two, or more applications/coats, such as by brushing or paste application. For example, the thickness of a solid intumescent may be in a range of about 22 mils (0.022 inch) to about 35 mills (0.035 inch), and the thickness of a liquid intumescent may be in a range of about 10 mils (0.010 inch) to about 30 mil (0.030 inch), although other thicknesses outside these ranges may be practiced. The thickness of non-intumescent fire retardant materials such as MIL-PRF-24596A flame retardant latex enamel may be on the order of about 1 mil (0.001 inch), although other thicknesses may be practiced.

The door core 30 may be a mineral core, such as formed from a calcium silicate board or the like. Such door cores 30 when used in a flush door may have a rating of 90 minutes. When used in a paneled door with contoured door skins, such as the door 10, the core will frequently have a reduced rating of 60 minutes. Mineral door cores are available from various suppliers such as Georgia Pacific. Mineral cores are also disclosed in U.S. Pat. Nos. 6,986,656 and 6,643,991. As an alternative to mineral core doors, other core materials such as medium density fiberboard and other wood composites may be used to attain a fire rating, and thus the fire retardant material may also be used with those and other core materials.

Figure 6:
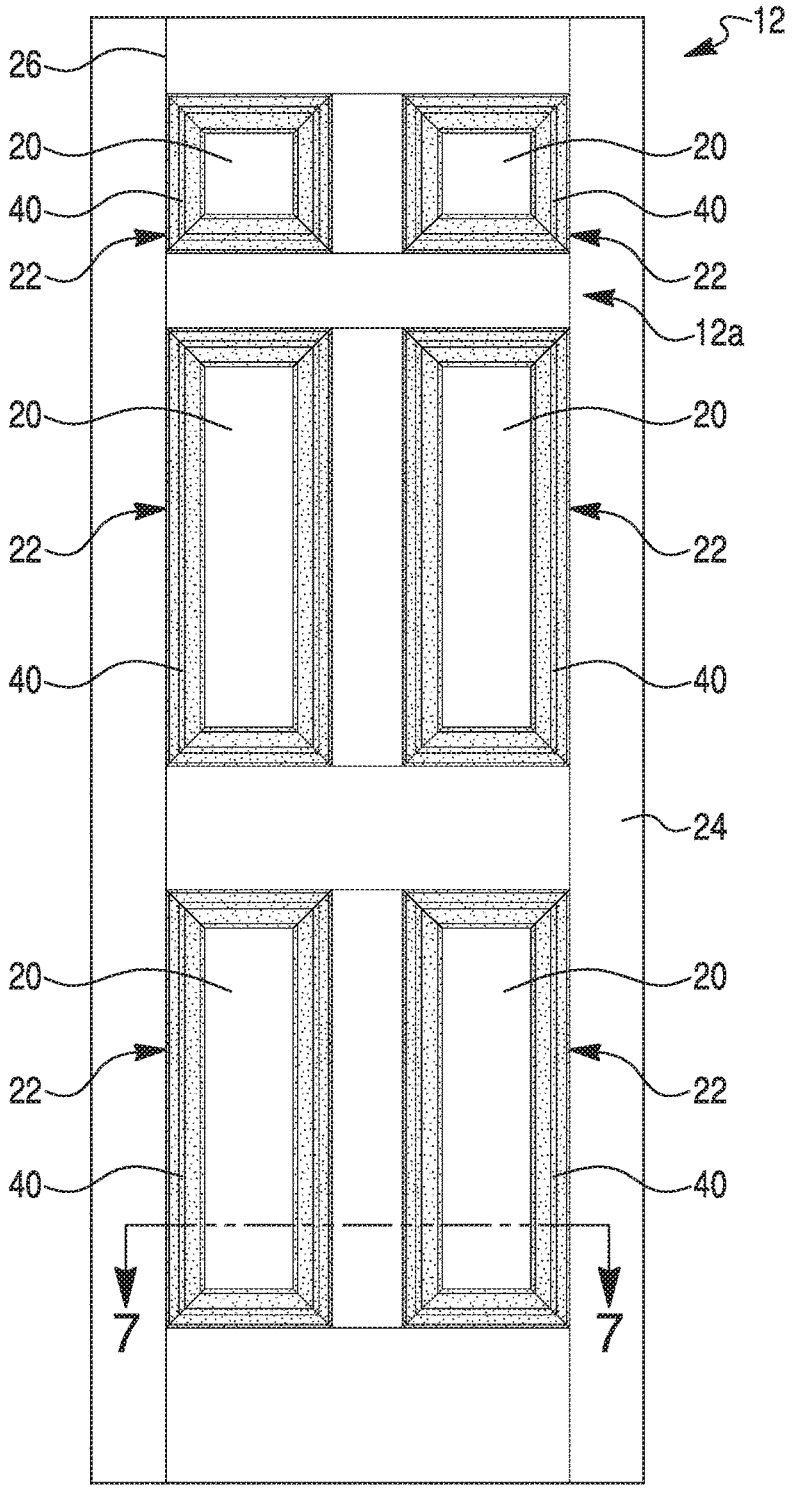
FIG. 6 is an elevational view of a six-panel solid core door having door skins selectively coated with fire retardant material according to another exemplary embodiment.

Another exemplary embodiment of the invention is illustrated in FIGS. 6 and 7. The exemplary embodiment of FIGS. 6 and 7 may be practiced alone or in combination with the embodiment of FIGS. 1-4 and/or the modified embodiment of FIG. 5. In FIGS. 6 and 7, the first door skin 12 is shown with the fire retardant material 40 coated on the exterior surface 12*a* at the contoured portions 22. As shown in FIGS. 6 and 7, the fire retardant material 40 (represented by stippling in FIG. 6) also may be coated on the exterior surface 14*a* of the second door skin 14. In applying the fire retardant material 40 to the exterior surfaces 12*a* and 14*a*, the fire retardant material 40 is largely isolated to the depressions defined by the contoured portions 22. A relatively small amount (e.g., 20 percent or less by surface area, preferably about 5 percent or less by surface area, preferably about 2 percent or less by surface area, preferably 0 percent by surface area of the exterior surface 12*a*) of the remainder of the exterior surfaces 12*a*, 14*a* outside of the depressions defined by the contoured portions 22, i.e., the inner panels 20 and the main body portion 24, may be coated with or otherwise receive the fire retardant material 40. A substantial portion (i.e., 80 percent or more by surface area, 95 percent or more by surface area, 98 percent or more by surface area, or 100 percent by surface area) of the remainder of the exterior surfaces 12*a*, 14*a* outside of, i.e., excluding, the depressions defined by the contoured portions 22 is not coated with (that is, is free of) any fire retardant material 40 coating. The fire retardant material 40 may be selected and applied as described above in connection with the embodiments of FIGS. 1-5. Although not shown, those skilled in the art will appreciate that the door core 30 of the exemplary embodiment of FIGS. 6 and 7 optionally may be treated with fire retardant material 40 such as intumescent material or non-intumescent material as described above in connection with FIGS. 1-5.

Figure 8:
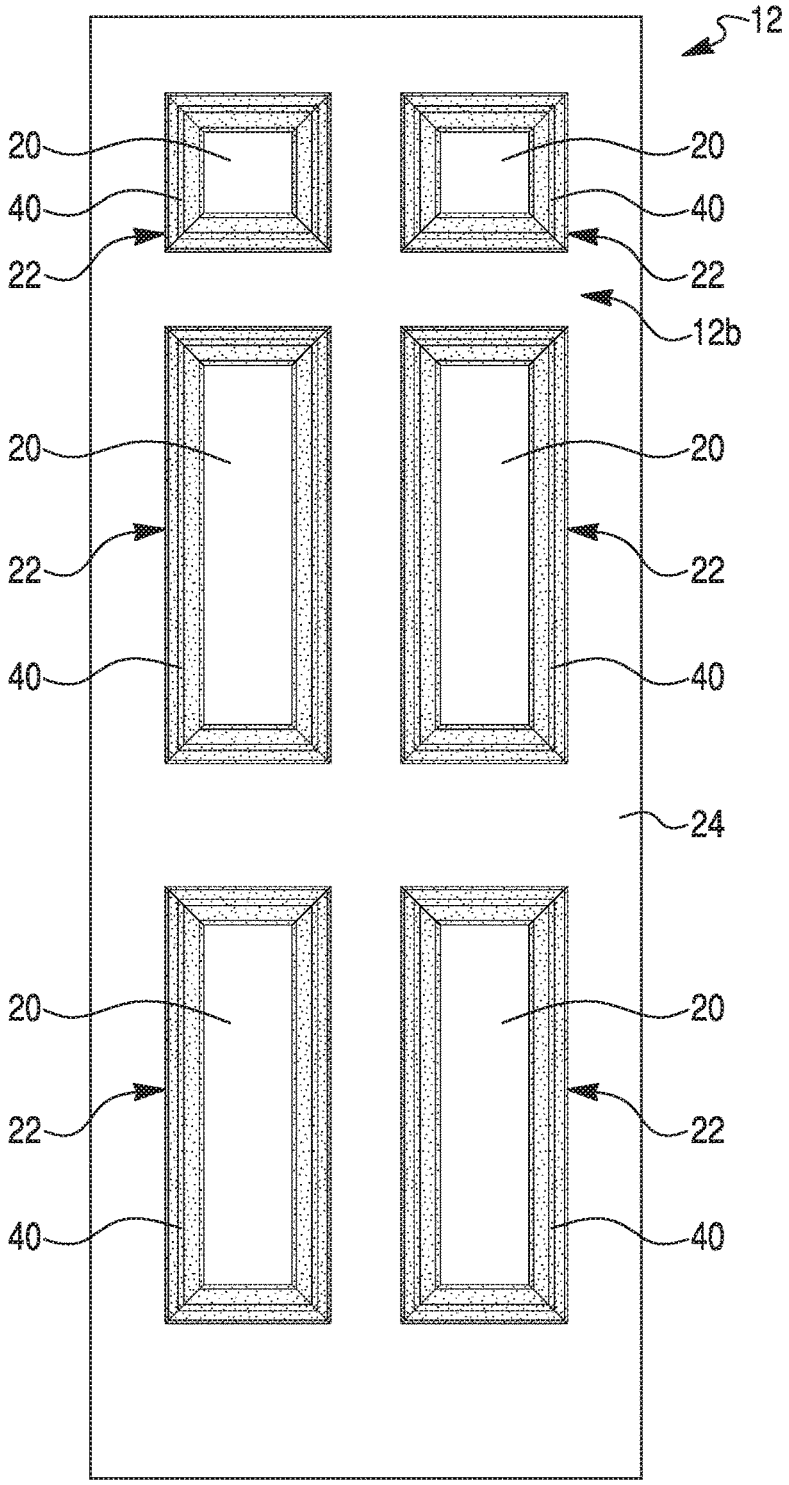
FIG. 8 is an elevational view of an interior surface of a six-panel door skin selectively coated with fire retardant material according to a further exemplary embodiment.
Figure 9:
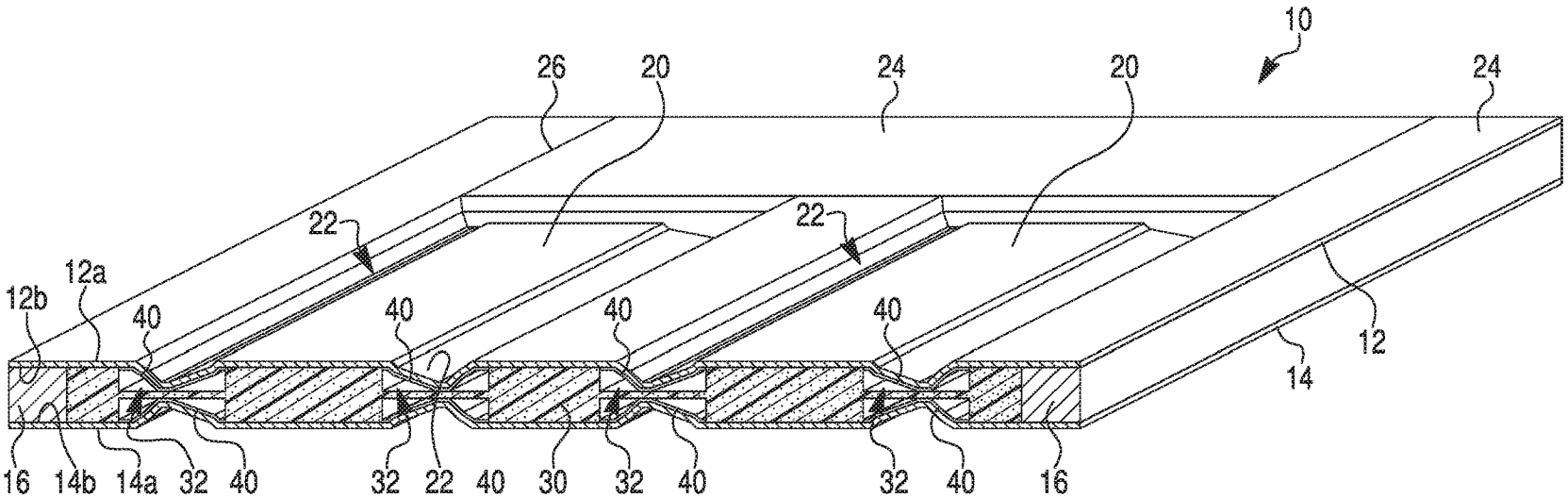
FIG. 9 is a cross-sectional view of a six-panel solid core door having front and rear door skins with interior surfaces selectively coated with fire retardant material.

Still another embodiment of the invention is illustrated in FIGS. 8 and 9. The embodiment of FIGS. 8 and 9 may be practiced alone or in combination with the embodiment of FIGS. 1-4, the modified embodiment of FIG. 5, and/or the embodiment of FIGS. 6 and 7. In FIGS. 8 and 9, the first door skin 12 is shown with the fire retardant material 40 (represented by stippling in FIG. 8) coated or otherwise applied onto the interior surface 12*b* at the contoured portions 22. As shown in FIG. 9, the fire retardant material 40 preferably is also coated on the interior surface 14*b* of the second door skin 14. In applying the fire retardant material 40 to the interior surfaces 12*b* and 14*b*, the fire retardant material 40 is largely isolated to the protrusions defined by the contoured portions 22. A relatively small amount (e.g., 20 percent or less by surface area, preferably about 5 percent or less by surface area, preferably about 2 percent or less by surface area, preferably 0 percent by surface area of the interior surface 12*b*) of the remainder of the interior surfaces 12*b*, 14*b* outside of the protrusions defined by the contoured portions 22, i.e., the inner panels 20 and the main body portion 24, may be coated with or otherwise receive the fire retardant material 40. A substantial portion (i.e., 80 percent or more by surface area, 95 percent or more by surface area, 98 percent or more by surface area, or 100 percent by surface area) of the remainder of the interior surfaces 12*b*, 14*b* outside of, i.e., excluding, the protrusions of the contoured portions 22 is not coated with (that is, is free of) any fire retardant material. The fire retardant material 40 may be selected and applied as described above in connection with the embodiments of FIGS. 1-7.

It has been found that doors including fire retardant material 40 applied in the recesses of the door core 30 or on the contoured portions of the door skins 12 and 14 exhibit enhanced heat and fire resistance. In the first embodiment, the fire retardant material 40 in the recessed portions 32 of the door core 30 compensates for the lesser thickness, and hence lower fire retardant content of the door core 30 at the recessed portions 32. In the embodiments described in connection with FIGS. 6-9, the locations of the contoured portions 22 correspond to the locations of the reduced-thickness recessed portions 32 in which the contoured portions 22 are at least partially received. Accordingly, providing the fire retardant material 40 on the contoured portions 22 of the exterior surfaces 12*a* and 14*a* and/or interior surfaces 12*b* and 14*b* of the door skins 12 and 14 at locations corresponding to the recessed portions 32 of the door core 30 compensates for the lesser thickness, and hence the lower fire retardant content of the door core 30 at the recessed portions 32.

As noted above, it is believed that the intumescent material acts as a heat sink. Consequently, heat resistance and fire performance of the door 10 as a whole can be improved without increasing the core structure thickness. Further, exemplary methods described herein may be practiced with good repeatability even when experiencing manufacturing variability, such as routing and assembly variations.

Intumescent materials have in the past been utilized with doors by application to the exposed edges of the frame 15 in order to provide a seal with the adjacent frame/jambs to which the door is appended. The resulting seal inhibits the ingress of smoke and like contaminants.

In the illustrated embodiments, the articles are depicted in the form of multi-panel doors, or, more particularly, thin door skins adhered or otherwise secured to opposite major surfaces of the core structure and door frame to simulate a solid core door, optionally with an appearance simulating a natural wood door. Although illustrated as an interior or exterior passage (or entry) solid core door, it should be understood that the principles described herein may be applied to other door applications, for example, hollow core doors, solid core doors having flush door skin(s), and acoustic doors. Optionally, the door may include only one door skin. It should be understood that the principles of the present invention apply to building and construction products other than doors.

The door skins 12, 14 may be formed of a composite material containing inorganic and/or organic filler, such as cellulosic fibers and/or particles, and a binder capable of adhesively binding the filler (e.g., cellulosic material) together into a structurally stable article. The organic fibrous material is typically relatively small fibers or particles of wood, e.g., pine, oak, cherry, maple and combinations of the same or other woods. Other cellulosic materials such as straw, rice husks and knaff may be used in combination with or as an alternative for wood fibers and/or particles. The cellulosic material may be present as dust, fibers, discrete particles, or other forms. The cellulosic material, whether in the form of refined fibrillated fibers, or in the form of discrete particles or sawdust, can be molded and adhered together with natural or synthetic binders to provide aesthetically pleasing contours and texture in exterior, visible surfaces. The binder may be selected from, for example, phenol-formaldehyde resin, urea-formaldehyde resin, and mixtures thereof.

High density fiberboard is particularly useful as the door skin material in various embodiments of the invention, although other materials such as medium density fiberboard may be selected. High density fiberboard generally contains a cellulosic fiber content of about 80 to about 97 percent by weight, based on dry weight. The binder typically constitutes about 2 to about 15 percent by weight of the dry weight of the article. Additional ingredients may also be included, such as sizing agents. Other materials that may be selected for the door skins include, by way of example, sheet molding compounds (SMCs), bulk molding compounds (BMCs), thermoplastics, thermosets, metal, and others. Inorganic fillers such as glass fibers may be included in the compositions to provide reinforcement. Other ingredients, such as thermoplastics, fillers (e.g., calcium carbonate, fiberglass), additives, and initiators may also be included in the door skin composition.

Door skins and other molded articles may be formed in accordance with molding procedures known in the art or otherwise useful for the purposes of practicing the present invention. Although not necessarily by limitation, the molding procedures usually employ a compression mold apparatus including upper and lower mold dies. One or both of the mold dies are movable towards and away from the other mold die. In the closed state, opposing surface of the mold dies define a mold cavity. The cavity-defining surface of the one of the mold dies (e.g., upper mold die) is shaped generally complementary or as the inverse of the desired shape of exterior surface 12*a* of door skin 12 or other article. The cavity-defining surface of the other mold die (e.g., lower mold die) has a shape that is generally complementary or the inverse of the desired shape of the interior surface 12*b* of door skin 12. The manufacture of mold dies having various surface features is known in the art.

Different molding techniques may be practiced in accordance with various embodiments of the invention, including compression molding, injection molding, thermoforming, vacuum molding, and re-forming of molded blanks. Examples of molding apparatus and procedures are described in U.S. Pat. Nos. 7,096,916, 6,743,318, and 6,579,483.

Testing according to ANSI/UL-10C was carried out on three door cores: a first mineral door core without intumescent material or other fire retardant on either side of the door core, a second mineral door core with solid intumescent material in recessed portions of both sides of the door core, and a third mineral door core having liquid intumescent material coating recessed portions on both sides of the door core. In the first part of the ANSI/UL-10C test, the door cores were heated in a furnace at 1300° F. (704° C.) at t=10 minutes, 1462° F. (795° C.) at t=20 minutes, 1550° F. (843° C.) at t=30 minutes, 1602° F. (872° C.) at t=40 minutes, and a side of the door core 30 exposed to the furnace was designated the "exposed surface." The temperatures of the non-exposed surfaces of the three door cores were recorded at 10 minutes, 20 minutes, 30 minutes, and 40 minutes. The results are tabulated in the Table below.

TABLE

| | Time (min) | | | | | | |
|---|---|---|---|---|---|---|---|
| | 10 | 20 | 30 | 40 | Approx. Rate of rise from t = 10 to t = 30 (° F./min) | Approx. % Decrease in rate for the first 30 min | % Difference in temperature at 40 min |
| Mineral core (° F.) | 160 | 304 | 430 | 465 | 13.5 | — | — |
| Mineral core with solid intumescent (° F.) | 165 | 210 | 283 | 355 | 5.9 | 56.30 | 23.66 |
| Mineral core with liquid intumescent (° F.) | 141 | 194 | 301 | 335 | 8 | 40.74 | 27.96 |

The temperature of the non-exposed surface of the comparative mineral door core without intumescent material increased much more quickly than the temperatures of the non-exposed surface of the mineral door cores coated with solid intumescent material in the recessed portions and the non-exposed surface of the door core coated with liquid intumescent coating in the recessed portions. For example, between t=10 minutes and t=30 minutes, the non-exposed surface of the mineral door core with the solid intumescent increased in temperature by 118° F. (283° F. minus 165° F.), compared to a much greater temperature increase of 270° F. (430° F. minus 160° F.) for the non-exposed side of the uncoated mineral door. This represents a percent decrease of 56.3% [(270° F.−118° F.)/270° F.×100. Similarly, between t=10 minutes and t=30 minutes, the non-exposed surface of the mineral door core with liquid intumescent increased in temperature by 160° F., compared to an increase of 270° F. for the uncoated mineral door, representing a percent decrease of 40.74% [(270° F.−160° F.)/270° F.×100] due to the liquid intumescent material. The non-exposed surface of the mineral door core with the solid intumescent was lower in temperature than the non-exposed surface of the uncoated mineral core door at t=40 minutes by 23.66% [(465° F.−355° F.)/465° F.×100], while the non-exposed surface of the mineral door core with the liquid intumescent was lower in temperature than the non-exposed surface of the uncoated mineral core door at t=40 minutes by 27.96% [(465° F.−335° F.)/465° F.×100]. These results represent significant retardation of heat transfer through the intumescent-coated door cores compared to the uncoated door core.

The foregoing detailed description of the certain exemplary embodiments has been provided for the purpose of explaining the principles of the invention and its practical application, thereby enabling others skilled in the art to understand the invention for various embodiments and with various modifications as are suited to the particular use contemplated. This description is not necessarily intended to be exhaustive or to limit the invention to the precise embodiments disclosed. The specification describes specific examples to accomplish a more general goal that may be accomplished in another way.

What is claimed is:

1. A door core comprising:

a door core body having a first major surface and a second major surface opposite to the first major surface, the first major surface comprising one or more first inner panels, one or more first recesses contiguous with and surrounding entireties of one or more first perimeters of the one or more first inner panels, and a first main body contiguous with and surrounding entireties of one or more first perimeters of the one or more first recesses, wherein the one or more first recesses are recessed from the one or more first inner panels and the first main body, and wherein the one or more first recesses continuously and integrally connect the one or more first inner panels to the first main body so that the one or more first inner panels, the one or more first recesses, and the first main body collectively constitute a unitary piece; and fire retardant material applied to the one or more first recesses and no more than 20 percent by surface area of a remainder of the first major surface excluding the one or more first recesses.

2. The door core of claim 1, wherein the fire retardant material is applied to no more than 5 percent by surface area of the remainder of the first major surface.

3. The door core of claim 1, wherein the fire retardant material is applied on no more than 2 percent by surface area of the remainder of the first major surface.

4. The door core of claim 1, wherein any of the fire retardant material applied to the remainder of the first major surface is contiguous with the fire retardant material coating the one or more first recesses.

5. The door core of claim 1, wherein the fire retardant material comprises an intumescent material.

6. The door core of claim 1, wherein the fire retardant material comprises a non-intumescent material.

7. The door core of claim 1, wherein:

the second major surface comprises one or more second inner panels, one or more second recesses contiguous with and surrounding entireties of one or more second perimeters of the one or more second inner panels, and a second main body continuous with and surrounding entireties of one or more second perimeters of the one or more second recesses, wherein the one or more second recesses are recessed from the one or more second inner panels and the second main body, and wherein the one or more second recesses continuously and integrally connect the one or more second inner panels to the second main body, and the fire retardant material is applied on the one or more second recesses and no more than 20 percent by surface area of a remainder of the second major surface excluding the one or more second recesses.

8. The door core of claim 7, wherein the fire retardant material is applied on no more than 2 percent by surface area of the remainder of the first major surface, and wherein the fire retardant material is applied on no more than 2 percent by surface area of the remainder of the second major surface.

9. The door core of claim 7, wherein the fire retardant material is applied to no more than 5 percent by surface area of the remainder of the first major surface, and wherein the fire retardant material is applied to no more than 5 percent by surface area of the remainder of the second major surface.

10. The door core of claim 1, wherein the one or more first recesses are routed.

11. A core door, comprising:

a frame having opposite first and second sides;

the door core as claimed in claim 1 having a periphery surrounded by the frame;

a first door skin secured to the first side of the frame; and a second door skin secured to the second side of the frame.

12. A door core, comprising:

a door core body having a first major surface and a second major surface opposite to the first major surface, the first major surface comprising at least one first inner panel, at least one first recess contiguous with and surrounding an entirety of the at least one first inner panel, and a first main body contiguous with and surrounding an entirety of the at least one first recess, wherein the at least one first recess is recessed from the at least one first inner panel and the first main body, and wherein the at least one first recess continuously and integrally connects the at least one first inner panel to the first main body so that the at least one first inner panel, the at least one first recess, and the first main body collectively constitute a unitary piece; and fire retardant material applied to the at least one first recess and none of a remainder of the first major surface excluding the at least one first recess.

13. The door core of claim 12, wherein the fire retardant material comprises an intumescent material.

14. The door core of claim 12, wherein the fire retardant material comprises a non-intumescent material.

15. The door core of claim 12, wherein the at least one first recess is routed.

16. A core door, comprising:

a frame having opposite first and second sides;

the door core as claimed in claim 12 having a periphery surrounded by the frame;

a first door skin secured to the first side of the frame; and a second door skin secured to the second side of the frame.

17. A door core comprising:

a door core body having a first major surface and a second major surface opposite to the first major surface, the first major surface comprising one or more first inner panels, one or more first recesses contiguous with and surrounding entireties of one or more first perimeters of the one or more first inner panels, and a first main body contiguous with and surrounding entireties of one or more first perimeters of the one or more first recesses, wherein the one or more first recesses are recessed from the one or more first inner panels and the first main body, and wherein the one or more first recesses continuously and integrally connect the one or more first inner panels to the first main body so that the one or more first inner panels, the one or more first recesses, and the first main body collectively constitute a unitary piece; and the second major surface comprising one or more second inner panels, one or more second recesses contiguous with and surrounding entireties of one or more second perimeters the one or more second inner panels, and a second main body contiguous with and surrounding entireties of one or more second perimeters of the one or more second recesses, wherein the one or more second recesses are recessed from the one or more second inner panels and the second main body, and wherein the one or more second recesses continuously and integrally connect the one or more second inner panels to the second main body; and fire retardant material applied to the one or more first recesses and the one or more second recesses and to neither of a remainder of the first major surface excluding the one or more first recesses nor a remainder of the second major surface excluding the one or more second recesses.

18. The door core of claim 17, wherein the fire retardant material comprises an intumescent material.

19. The door core of claim 17, wherein the fire retardant material comprises a non-intumescent material.

20. The door core of claim 17, wherein the one or more first recesses are routed and wherein the one or more second recesses are routed.

21. A core door, comprising:

a frame having opposite first and second sides;

the door core as claimed in claim 17 having a periphery surrounded by the frame;

a first door skin secured to the first side of the frame; and a second door skin secured to the second side of the frame.

* * * * *